US005636484A

United States Patent [19]

DeBlock

[11] Patent Number: 5,636,484

[45] Date of Patent: Jun. 10, 1997

[54] HURRICANE DOOR LIGHT

[75] Inventor: David A. DeBlock, Holland, Mich.

[73] Assignee: ODL Incorporated, Zeeland, Mich.

[21] Appl. No.: 288,819

[22] Filed: Aug. 11, 1994

[51] Int. Cl.[6] ..... E06B 1/14; E06B 1/32; E06B 1/36; E06B 1/60

[52] U.S. Cl. ..... 52/204.5; 52/171.1; 52/203; 52/204.6; 52/204.62; 52/204.72; 52/208; 52/770; 52/781.3; 52/786.1

[58] Field of Search ..... 52/171.1, 203, 52/208, 455, 789, 204.6, 204.62, 204.63, 204.7, 204.72, 786.1, 204.5, 770, 781.3; 49/171, 501; 109/10, 80, 82

[56] References Cited

U.S. PATENT DOCUMENTS

| | | | |
|---|---|---|---|
| 3,630,814 | 12/1971 | Arnold | 52/790 X |
| 3,837,129 | 9/1974 | Losell | 52/789 X |
| 4,027,443 | 6/1977 | Briggs | 52/202 |
| 4,030,258 | 6/1977 | Anders | 109/10 X |
| 4,081,581 | 3/1978 | Littell, Jr. | 52/789 X |
| 4,084,347 | 4/1978 | Brown | 49/501 X |
| 4,324,373 | 4/1982 | Zibritosky | 52/208 X |
| 4,368,226 | 1/1983 | Mucaria | 52/789 X |
| 4,525,961 | 7/1985 | Hansen | 52/208 |
| 4,947,606 | 8/1990 | La See | 52/455 |
| 4,979,342 | 12/1990 | Holdridge et al. | 52/171.1 |

*Primary Examiner*—Christopher-Todd Kent
*Attorney, Agent, or Firm*—Warner Norcross & Judd

[57] ABSTRACT

A penetration resistant door light adapted to withstand impact from flying debris as might occur in a hurricane or other high-wind condition. The door light includes inner and outer frame halves that support a panel assembly within an opening formed in a door. The panel assembly includes a sheet or layer of transparent impact resistant material such as a polycarbonate or laminated glass. The impact resistant sheet is structurally secured to at least screws extend through all of the inner frame half, the impact resistant sheet, and the outer frame half. In an alternative embodiment, a structural adhesive intersecures the impact resistant sheet and the outer frame half.

8 Claims, 4 Drawing Sheets

HURRICANE DOOR LIGHT

BACKGROUND OF THE INVENTION

The present invention relates to windows, and more particularly to windows known as door lights adapted for mounting in doors.

A door light is a window assembly that is adapted for installation within a door. Door lights are available in a wide variety of sizes and shapes, and come in two basic designs—fixed and ventilated. A fixed door light supports a stationary panel of window glass, while a ventilated door light supports a panel of window glass in a movable sash.

Exterior doors, and consequently door lights installed therein, are part of the "building envelope", which essentially includes those elements that compose the exterior of the building. As part of the building envelope, door lights are subjected to a variety of weather extremes. Accordingly, an increasing number of localities are increasing the structural standards applicable to door lights. In particular, many localities are adopting ordinances that include strenuous impact standards which retire a door light to withstand the impact of a missile driven by the high winds of a hurricane or tornado. The prior art does not provide a door light that complies with these stringent impact retirements.

Even in the absence of hurricane conditions, it is often desirable to have a door light of increased strength and durability. For example, conventional door lights often do not meet retirements for commercial applications.

SUMMARY OF THE INVENTION

The aforementioned problems are overcome by the present invention wherein a door light is provided having a strong impact resistant frame, a high-strength glazing material supported by the frame, and means for structurally intersecuring the glazing material to the frame. The glazing is sufficiently strong to resist penetration in impact tests. The frame is sufficiently strong to maintain the glazing in the door opening. The structural intersecurement of the two prevents them from separating.

In both embodiments, the invention includes a frame assembly having outer and inner frame halves which sandwich and support a fixed panel of glazing material, such as glass, plastic, or any combination of clear or translucent sheets. The outer and inner frame halves are intersecured by screws, extending through the inner frame into the outer frame half.

In the first embodiment, the glazing is an insulating construction including a polycarbonate sheet supported between and spaced from two glass panels. The polycarbonate sheet includes portions that extend beyond the glass panels between the frame mounting bosses to secure the sheet directly to the frame.

In a second embodiment, the door light includes a laminated glass panel and a conventional glass panel intersecured and spaced from one another in an insulating glass construction. The laminated glass panel faces the outside of the door light and is secured to the outer frame by structural silicone.

The present invention provides simple, yet effective, door light constructions that are capable of withstanding high impact forces. In addition, the polycarbonate sheet of the first embodiment and the laminated glass of the second embodiment are structurally secured to the frame to prevent them from dislodging during impact.

These and other objects, advantages, and features of the invention will be more fully understood and appreciated by reference to the detailed description of the preferred embodiment and the drawings.

DETAILED DESCRIPTION OF THE PREFERRED EMBODIMENTS

Figure 1:
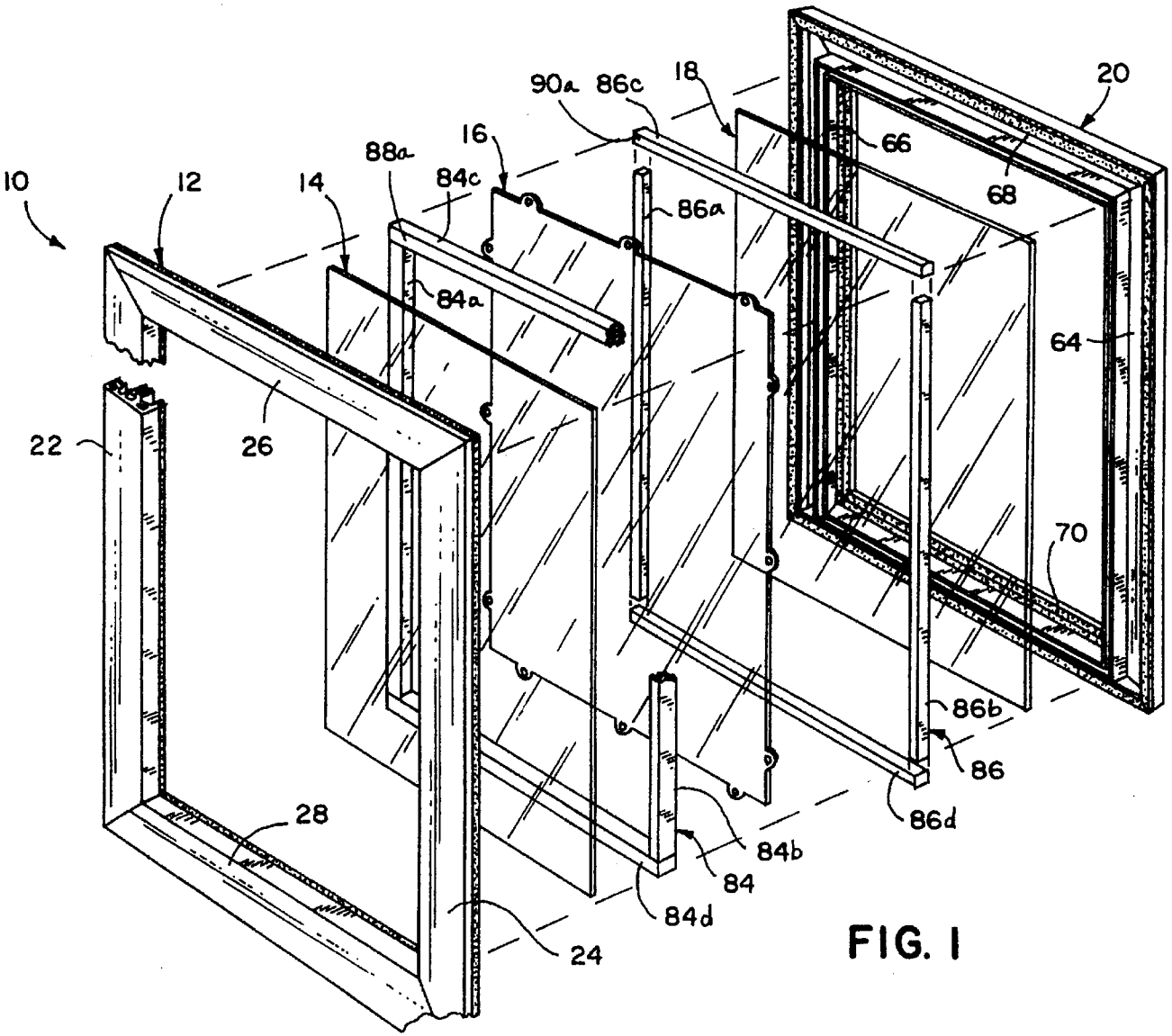
FIG. 1 is an exploded perspective view of the first embodiment of the door light.

By way of disclosure and not by way of limitation, a door light constructed in accordance with a first embodiment of the present invention is illustrated in FIGS. 1–4 and generally designated 10. The light includes an outer frame half 12, a glass assembly 13, and an inner frame half 20. The glass assembly 13 includes an outer glass panel 14, a polycarbonate sheet 16, and an inner glass panel 18. Various other combinations of glass, plastic or other clear or translucent materials may replace the described glass assembly.

As perhaps best illustrated in FIG. 1, the outer frame half 12 is generally rectangular and includes two side members 22, 24 that extend between upper and lower members 26 and 28. The individual members are separately fabricated and then assembled by mitre cutting and welding the members to form the outer frame half 12. Preferably, the individual portions are an extruded aluminum profile to give the frame relatively high strength. However, a variety of other materials may be substituted depending on the test to be met, including wood or high strength, high impact polymeric materials.

The profile of the outer frame half 12 (FIG. 4) includes a generally flat outer wall 30 from which extends a pair of parallel spaced walls 35 and 37. Walls 35 and 37 are interconnected by an inner wall 39 extending parallel to outer wall 30. A pair of parallel spaced ribs 31 and 33 extend from inner wall 39 opposite walls 35 and 37. The ribs 31 and 33 cooperate to function as a mounting boss extending around the entire outer frame half 12. The ribs 31 and 33 are preferably spaced apart a distance equal to the width of the shank of the mounting screws 50 used to intersecure the inner and outer frames. In addition, the facing surfaces of the ribs 31 and 33 are longitudinally grooved with a pitch matching the threads of the mounting screws 50. The height of ribs 31 and 33 and walls 35 and 37 are selected to accommodate the glass thickness as will be described.

A door-engagement flange 32 extends from a first longitudinal edge of the outer wall 30. The flange 32 engages door 100 to support the door light 10 within the door. A peripheral tongue 36 extends from the outer wall 30 in spaced apart relation from the door-engagement flange 32. The door-engagement flange 32 and tongue 36 cooperate to define a groove 38 for seating a gasket 40.

The outer wall 30 further includes a glass-engagement flange 42. The glass-engagement flange 42 extends from the second longitudinal edge of the outer wall 30 to engage and support the outer glass panel 14. A support wall 43 extends between the glass-engagement flange 42 and the juncture of walls 37 and 39. A peripheral tongue 44 extends from the support wall 43 in spaced apart relation to the glass-engagement flange 42. The glass-engagement flange 42 and tongue 44 cooperate to define a groove 46 for seating a gasket material 48.

Figure 6:
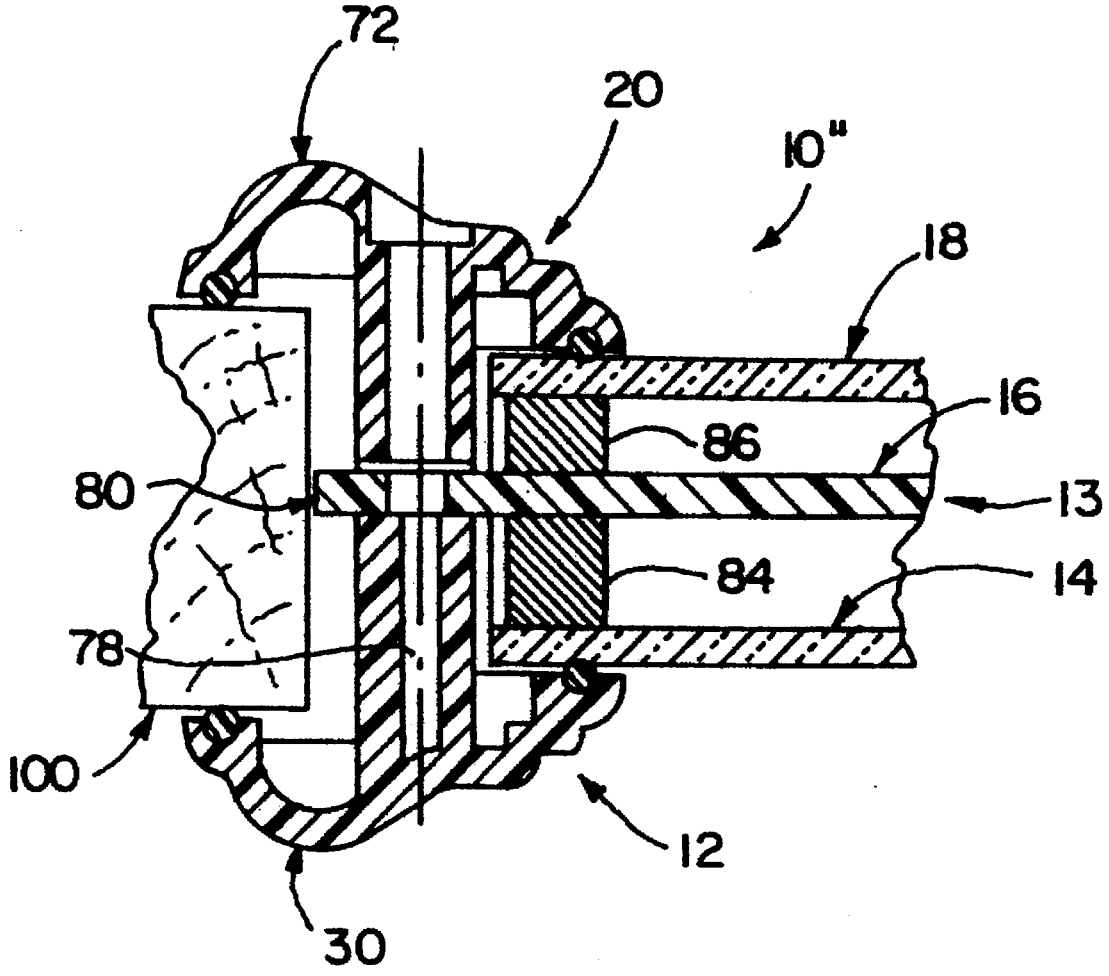
FIG. 6 is a sectional view of a door light having an alternative profile.

The outer frame half 12 is illustrated as having a preferred profile. However, a variety of profiles are possible to provide a door light meeting the needs and preferences of consumers. For example, FIG. 6 illustrates a door light having an alternative profile.

The inner frame half 20 is a near mirror image of the outer frame half 12, and includes a pair of side members 64, 66 extending between upper and lower members 68 and 70. The inner frame 20 includes an outer wall 72 having glass-engagement and door-engagement flanges 74 and 76 dimensioned to match the glass-engagement and door-engagement flanges 42 and 32 of the outer frame half 12. The inner frame half 20 also includes a pair of peripheral tongues 71*a*, 71*b* extending in spaced apart relation to flanges 74 and 76 to define a pair of grooves 73*a*, 73*b* for seating gaskets 75*a*, 75*b*.

The inner frame half 20 further includes a pair of parallel spaced apart walls 47 and 49 extending from outer wall 72, an inner wall 51 extending between walls 47 and 49, a pair of parallel ribs 53 and 55 extending from inner wall 51, and a support wall 59 extending between glass-engagement flange 74 and the juncture of walls 47 and 51.

A plurality of clearance holes 78 extend through the outer and inner walls 72 and 51. The holes 78 further extend between and partially into the ribs 53 and 55. The clearance holes 78 remove a portion of the ribs to provide sufficient clearance for the mounting screws to pass freely therebetween. The clearance holes 78 are counterbore to provide a hole 78*a* large enough for the head of the mounting screws 50 to pass through the outer wall 72. In addition, the inner wall 51 is countersunk 78*b* to seat the head of the mounting screws 50. The clearance holes 78 and ribs 53 and 55 cooperate to function as a plurality of mounting bosses disposed at spaced locations around the inner frame half 20. Preferably, a screw hole plug 57 is inserted into each counterbore 78*a* to hide the mounting screws 50.

The inner and outer glass panels 18 and 14 are substantially rectangular panes dimensioned to fit within bosses 32, 78 on the inner and outer frame halves. Presently, the glass panels 14, 18 are ⅛th inch tempered safety glass to prevent glass shards from being thrown from the window during an impact. Alternatively, the glass panels 14, 18 may be replaced by other known transparent panels, such as acrylic plastic sheets.

Figure 2:
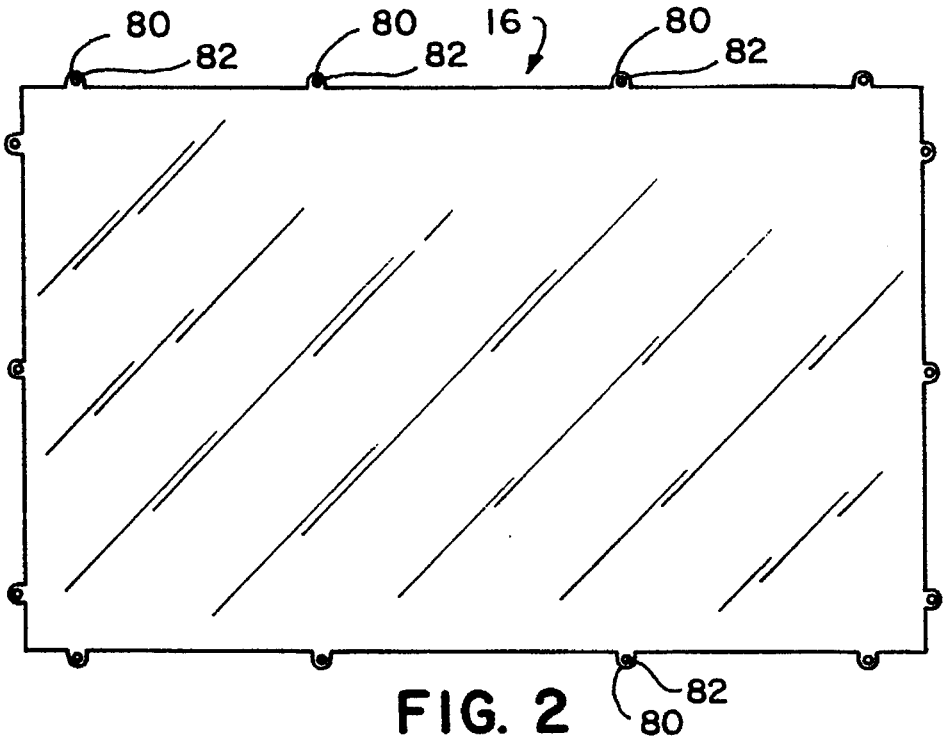
FIG. 2 is a plan view of the polycarbonate sheet.
Figure 3:
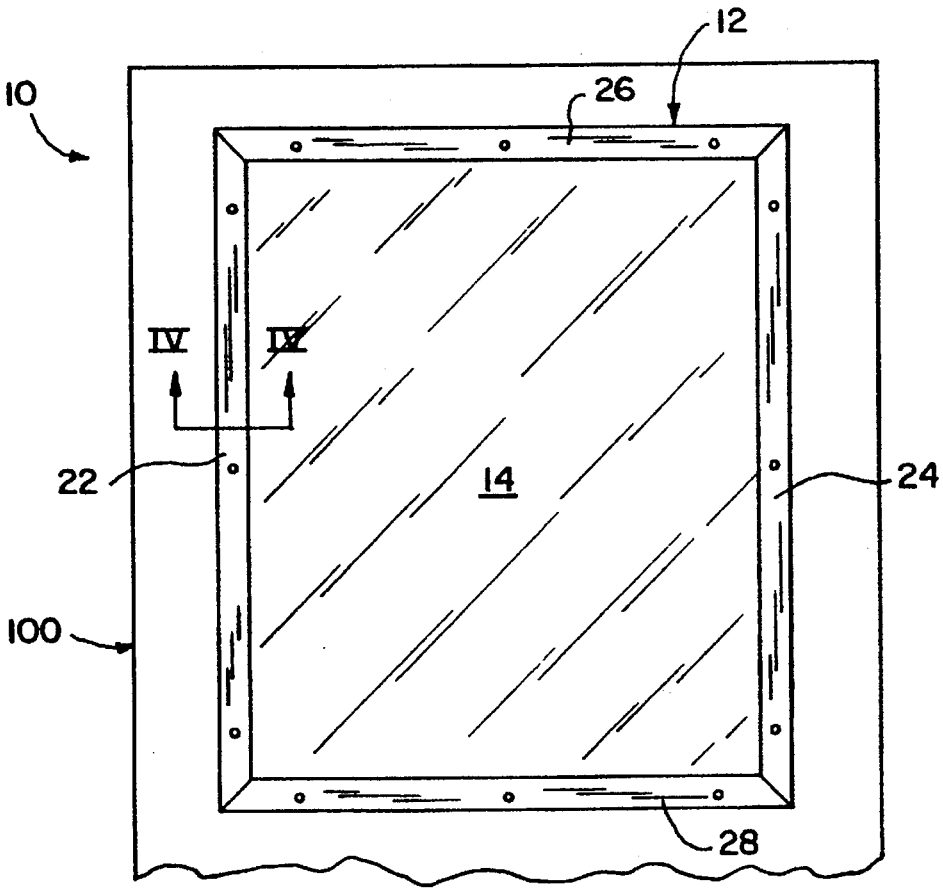
FIG. 3 is a rear elevational view of the door light.
Figure 4:
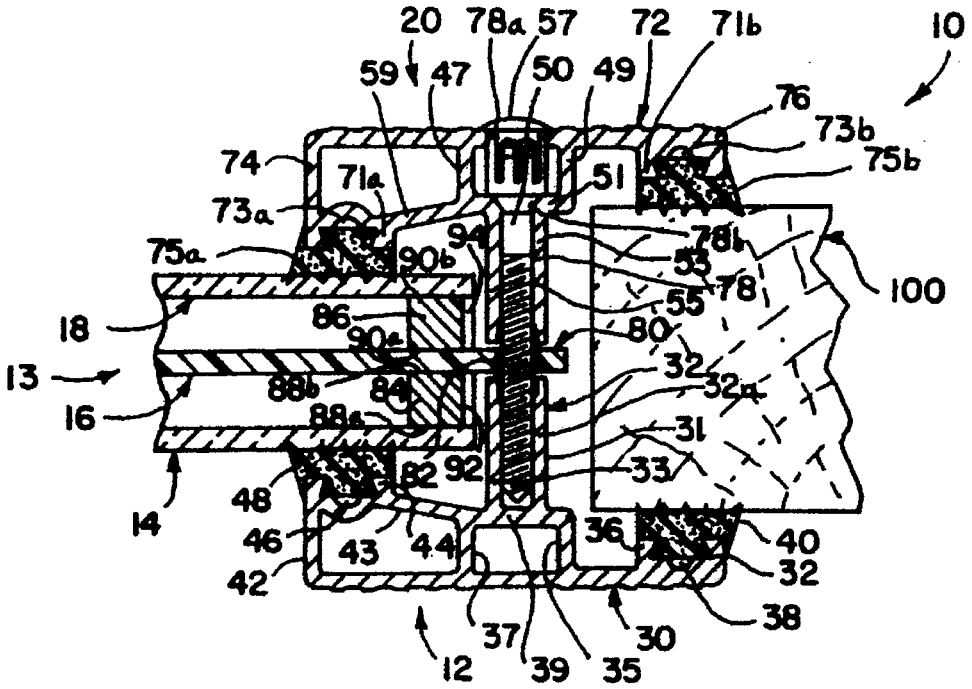
FIG. 4 is a fragmentary sectional view taken along plane IV—IV in FIG. 3.

The polycarbonate sheet 16 is a substantially rectangular transparent panel whose major dimensions are generally identical to the glass panels 14, 18. A plurality of mounting tabs or portions 80 extend laterally beyond the glass panels 14 and 18. The tabs 80 extend to a location positioning them between the ribs 31, 33, 53, and 55 during installation. As shown in FIGS. 2 and 4, the tabs 80 each include a mounting hole 82 in axial alignment with the clearance holes 78 extending through the inner frame 20. As an alternative, the tabs 80 may be eliminated by increasing the dimensions of the polycarbonate sheet 16 such that its peripheral edges extend between the ribs 31, 33, 53 and 55. According to this alternative, the mounting holes 82 are formed along the peripheral edge of the sheet 16 to align with the clearance holes 78. Appropriate transparent polycarbonate sheets are currently available from General Electric under the trade name Lexan.

As perhaps best illustrated in FIG. 1, the glass panels 14 and 18 are attached to and spaced from the polycarbonate sheet 16 by spacers frames 84, 86, respectively. The spacer frames 84, 86 each include a pair of opposite edges 88*a–b*, 90*a–b* which face the polycarbonate sheet 16 and adjacent glass panel 14 or 18, respectively. Each spacer frame 84, 86 includes two upright members 84*a–b*, 86*a–b* and upper and lower members 84*c–d*, 86*c–d*. The spacer frames 84, 86 are dimensioned to follow the peripheral edge of the glass panels 14, 18 where they are located between the inner flanges 42, 74. In this position, the clamping force exerted by the inner and outer frame halves 12 and 20 will be applied directly to the spacer frames. The spacer frames 84, 86 are slightly recessed from the outer edges of the glass panels 14, 18 and polycarbonate sheet 16. This defines a channel 92, 94 around the periphery of each spacer frame 14, 18. The spacer frames 84, 86 are preferably elongated roll formed or extruded aluminum having a substantially rectangular cross section. In addition, a desiccant, such as Molsiv 2000 sold by Union Carbide, is preferably located inside the spacer frames 84, 86 to absorb any moisture and/or humidity within the air trapped between the window panes 14, 16, and 18 during assembly.

While the present door light has been described with matching inner and outer frame half 12 and 20 profiles, it is within the scope of the present invention to provide the two frame halves with different profiles. For example, the outer frame half 12 may be provided with an arcuate profile (See FIG. 6) to match the design characteristics of the exterior of the building, while the inner frame half 20 is provided with a planar profile (See FIG. 4) to match the interior of the building.

The present invention is described in connection with a preferred triple pane construction. However, it is within the scope of the present invention to alter the number and/or arrangement of glass panels and polycarbonate sheets. For example, one or both of the glass panels may be eliminated or additional polycarbonate sheets may be added. However, the structural sheet is essential.

Assembly and Installation

The present invention is adapted for installation within an opening formed in a door 100. The door light 10 may come in various shapes and styles to fit within nearly any opening.

The glass panels 14, 18 and polycarbonate sheet 16 are cut to the relative dimensions and shapes described above. The two aluminum spacers 84, 86 are roll formed, cut to length, and welded.

As presently anticipated, a butyl sealant is applied about the entire periphery of each spacer frame 84, 86 along edges 88*a–b* and 90*a–b*. The butyl sealant may also be applied along the joints between adjacent spacer members to ensure a hermetic seal. Spacer frame 84 is sandwiched between glass panel 14 and polycarbonate sheet 16, and spacer frame 86 is sandwiched between glass panel 18 and polycarbonate sheet 16. Alternative sealing methods and materials are known to those of ordinary skill in the insulating glass art.

Channels 92 and 94 are then filled with an adhesive that intersecures the glass panels 14, 18 and polycarbonate sheet 16 to form a complete panel assembly 13. The presently preferred adhesive is polysulfide. Once again, this is only a preferred method, and those of ordinary skill in the art will recognize alternative methods for intersecuring the glass panels and polycarbonate sheet.

The frame halves 12 and 20 are manufactured and assembled with the glass 14, 16, and 18 to create a product ready for shipping. The screws 50 are shipped with the light 10, but are not secured in the frames. The door light installer will cut or otherwise form an opening in the door 100 two inches narrower and two inches shorter than the outer frame 12. Conventional gaskets 40, 48, and 75*a–b* are mounted to the inner and outer frame halves 12 and 20 within grooves 38, 46, and 73*a–b*. While conventional gaskets are preferred for use with aluminum frame halves, they may be replaced by a conventional gasket material or sealant when appropriate. Next, the outer frame half 12 is inserted into the door opening from the outside. The panel assembly 13 is inserted into the opening from the inside of the door 100. Subsequently, the inner frame half 20 is positioned in the opening adjacent the panel assembly 13 from the inside of the door. The clearance holes 78 in the inner frame half 20 are aligned with the tabs 80 of the polycarbonate sheet 16 and the ribs 31 and 33 of the outer frame half 12 to allow the mounting screws to pass therethrough.

Once the panel assembly and frame halves are properly aligned, mounting screws 50 are inserted through clearance holes 78 and tabs 80 to threadedly engage the grooves in ribs 31 and 33. The screws 50 draw the two frame halves 12, 20 together to rigidly 5 sandwich (a) the door 100 between the door-engagement flanges 32, 76, (b) the glass assembly 13 between the glass-engagement flanges 42, 74, and (c) the tabs 80 between the ribs 31, 33, 53, and 55. This compresses gaskets 40, 48, and 75*a–b* to seal the outer and inner frame halves 12, 20 against the glass panel assembly 13 and the door 100. And finally, screw hole plugs 57 are inserted into each clearance hole 78 to hide the mounting screws 50.

Second Embodiment

Figure 5:
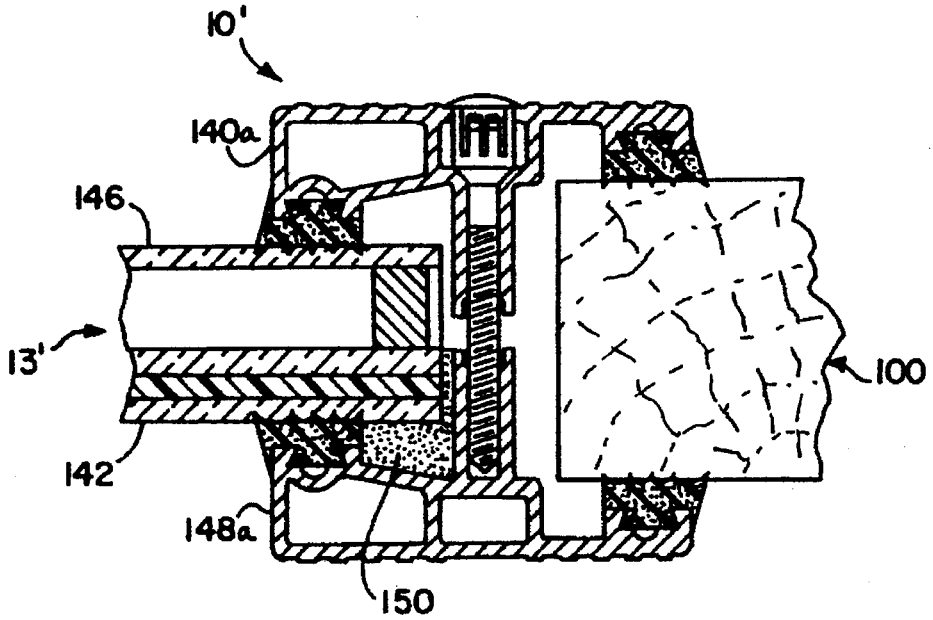
FIG. 5 is a sectional view similar to FIG. 4 of the second embodiment of the door light.

In a second embodiment illustrated in FIG. 5, the glass assembly 13 is replaced by a panel assembly 13' including a laminated glass panel 142 and a conventional glass panel 146. With the exception of the glass assembly 13', the construction of the door light 10' is generally identical to the corresponding elements described above in connection with the preferred embodiment.

The laminated glass panel 142 is a substantially rectangular pane of conventional laminated glass manufactured to fit between the glass-engagement flanges 140*a* and 148*a* of the inner and outer frame halves. The laminated glass panel 142 preferrably includes a 0.092 inch polybutylene sheet sandwiched between two ⅛-inch panels of high strength glass. The panel 146 is ⅛-inch glass and has generally identical dimensions as laminated panel 142. The panels 142 and 146 are intersecured in an insulating glass construction using the spacer frame 142 as described in conjunction with the first embodiment.

A structural silicone 150, or other structural adhesive, structurally secures the insulating glass assembly 13', and specifically the laminated glass panel 142 directly to the outer frame half 148*a*. Typically, the glass 142 will be laminated remotely from the window assembly and supplied to the window manufacturer.

The above descriptions are those of preferred embodiments of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A door light comprising:

an inner frame half;

an outer frame half;

a laminated glass assembly including a piece of glass and a sheet of transparent, impact resistant, resilient, polymeric material bonded to said piece of glass, said laminated glass assembly disposed between said inner and said outer frame halves; and structural adhesive structurally intersecuring said outer frame half and said laminated glass assembly.

2. The door light of claim 1 further comprising a second piece of glass intersecured to said sheet of impact resistant material in a spaced insulating construction.

3. The door light of claim 1 wherein said impact resistant material is a polycarbonate.

4. The door light of claim 2, further comprising a third transparent sheet intersecured to said sheet of impact resistant material in a spaced insulating construction opposite said second transparent sheet.

5. The door light of claim 4 wherein each of said frame halves includes a plurality of mounting holes, and further comprising a plurality of mounting screws, each of said mounting screws extending through one of said mounting holes.

6. The door light of claim 1 wherein said impact resistant material is polybutylene having a thickness of at least about 0.092 inches.

7. A window comprising:

an outer frame half to be mounted within an opening formed in a supporting structure;

a laminated glass including a piece of glass and a transparent, impact resistant, resilient, polymeric sheet bonded to said piece of glass;

an inner frame half to be mounted within said opening in said support structure;

fastener means for intersecuring said inner and said outer frame halves; and a structural adhesive adhesively and structurally securing said said laminated glass to said outer frame half.

8. The window of claim 7 wherein said impact resistant sheet is polybutylene having a thickness of at least about 0.092 inches.

* * * * *

US005636484C1

(12) EX PARTE REEXAMINATION CERTIFICATE (5907th)

United States Patent
DeBlock

(10) Number: US 5,636,484 C1
(45) Certificate Issued: Oct. 2, 2007

(54) HURRICANE DOOR LIGHT

(75) Inventor: David A. DeBlock, Holland, MI (US)

(73) Assignee: ODL, Incorporated, Zeeland, MI (US)

Reexamination Request:
No. 90/007,960, Mar. 1, 2006

Reexamination Certificate for:

| | |
|---|---|
| Patent No.: | **5,636,484** |
| Issued: | **Jun. 10, 1997** |
| Appl. No.: | **08/288,819** |
| Filed: | **Aug. 11, 1994** |

(51) Int. Cl.

| | |
|---|---|
| ***E06B 1/14*** | (2006.01) |
| ***E06B 1/32*** | (2006.01) |
| ***E06B 1/36*** | (2006.01) |
| ***E06B 1/60*** | (2006.01) |

(52) U.S. Cl. ..... 52/204.5; 52/171.1; 52/203; 52/204.6; 52/204.62; 52/204.72; 52/208; 52/770; 52/781.3; 52/786.1

(58) Field of Classification Search ..... 52/204.5, 52/204.67, 204.68, 204.71, 204.72, 204.53, 52/204.54

See application file for complete search history.

(56) References Cited

U.S. PATENT DOCUMENTS

| | | | | |
|---|---|---|---|---|
| 2,356,878 A | | 8/1944 | Painter | 189/64 |
| 2,576,392 A | | 11/1951 | Downes | 189/64 |
| 3,343,317 A | | 9/1967 | Cripe | 52/208 |
| 3,415,701 A | | 12/1968 | Haldane et al. | 156/244 |
| 3,566,499 A | | 3/1971 | James | 29/155 |
| 4,046,933 A | | 9/1977 | Stefanik | 428/81 |
| 4,151,696 A | | 5/1979 | Knights et al. | 52/741 |
| 4,947,597 A | | 8/1990 | Simpson | 52/208 |
| 5,038,537 A | | 8/1991 | Frambach | 52/207 |
| 5,315,952 A | * | 5/1994 | Jackson, Jr. | 114/312 |

* cited by examiner

*Primary Examiner*—Matthew C. Graham

(57) ABSTRACT

A penetration resistant door light adapted to withstand impact from flying debris as might occur in a hurricane or other high-wind condition. The door light includes inner and outer frame halves that support a panel assembly within an opening formed in a door. The panel assembly includes a sheet or layer of transparent impact resistant material such as a polycarbonate or laminated glass. The impact resistant sheet is structurally secured to at least screws extend through all of the inner frame half, the impact resistant sheet, and the outer frame half. In an alternative embodiment, a structural adhesive intersecures the impact resistant sheet and the outer frame half.

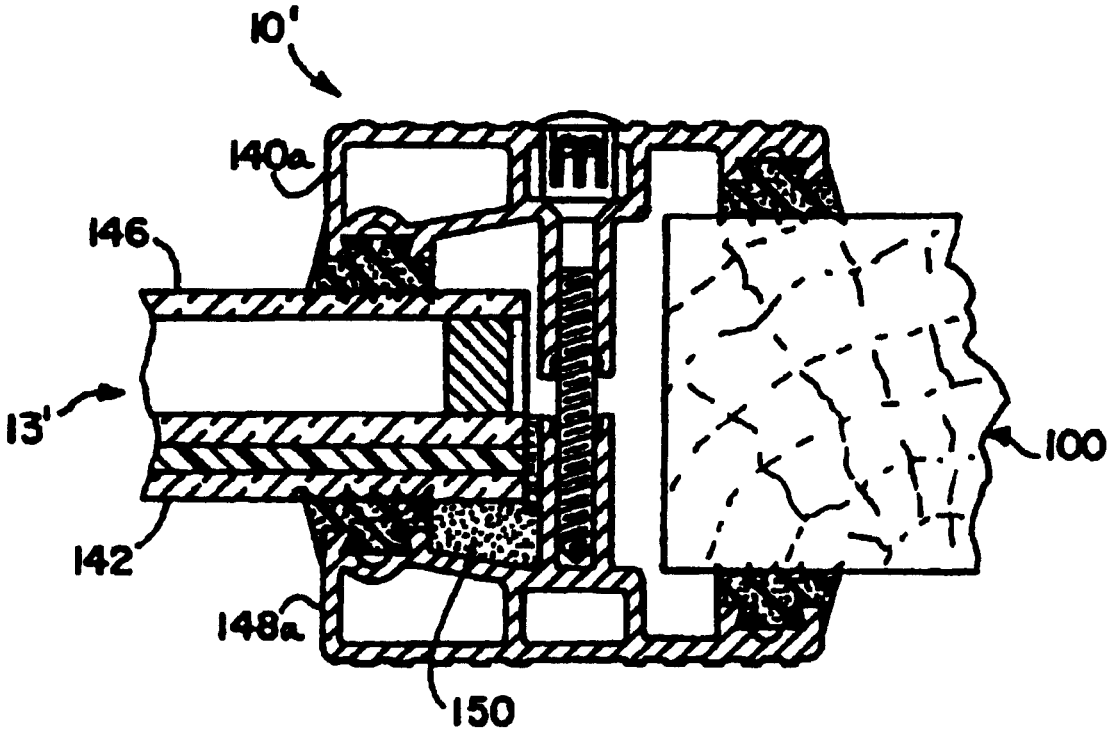

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 and 6–8 are determined to be patentable as amended.

Claims 4 and 5, dependent on an amended claim, are determined to be patentable.

New claims 9 and 10 are added and determined to be patentable.

1. A door light *for a building door* comprising:

an inner frame half;

an outer frame half;

a laminated glass assembly including a piece of glass and a sheet of transparent, impact resistant, resilient, polymeric material bonded to said piece of glass, said laminated glass assembly disposed between said inner and said outer frame halves; and structural adhesive structurally intersecuring said outer frame half and said laminated glass assembly.

2. The door light of claim [1] *9* further comprising a second piece of glass intersecured to said sheet of impact resistant material in a spaced insulating construction.

3. The door light of claim [1] *9* wherein said impact resistant material is a polycarbonate.

6. The door light of claim [1] *9* wherein said impact resistant material is polybutylene having a thickness of at least about 0.092 inches.

7. A [window] *building door assembly* comprising:

*a building door defining an opening;* an outer frame half to be mounted within [an] *said* opening [formed in a supporting structure];

a laminated glass including a piece of glass and a transparent, impact resistant, resilient, polymeric sheet bonded to said piece of glass;

an inner frame half to be mounted within said opening [in said support structure];

fastener means for intersecuring said inner and said outer frame halves; and a structural adhesive adhesively and structurally securing said [said] laminated glass to said outer frame half.

8. The [window] *building door assembly* of claim [7] *10* wherein said impact resistant sheet is polybutylene having a thickness of at least about 0.092 inches.

*9. The door light of claim 1 wherein:*

*the door includes two sides;*

*said laminated glass assembly includes two sides;*

*said outer frame half includes a first portion adapted to engage one of said door sides and a second portion engaging one of said laminated glass sides; and*

*said inner frame half includes a first portion adapted to engage the other of said door sides and a second portion engaging the other of said laminated glass sides.*

*10. The building door assembly of claim 7 wherein:*

*said door includes two sides;*

*said laminated glass includes two sides;*

*said outer frame half includes a first portion engaging one of said door sides and a second portion engaging one of said laminated glass sides; and*

*said inner frame half includes a first portion engaging the other of said door sides and a second portion engaging the other of said laminated glass sides.*

* * * * *

US005636484C2

(12) EX PARTE REEXAMINATION CERTIFICATE (7473rd)

United States Patent

DeBlock

(10) Number: US 5,636,484 C2

(45) Certificate Issued: Apr. 27, 2010

(54) HURRICANE DOOR LIGHT

(75) Inventor: David A. DeBlock, Holland, MI (US)

(73) Assignee: ODL, Incorporated, Zeeland, MI (US)

Reexamination Request:
No. 90/009,169, Jul. 14, 2008

Reexamination Certificate for:

| | |
|---|---|
| Patent No.: | **5,636,484** |
| Issued: | **Jun. 10, 1997** |
| Appl. No.: | **08/288,819** |
| Filed: | **Aug. 11, 1994** |

Reexamination Certificate C1 5,636,484 issued Oct. 2, 2007

(51) Int. Cl.

| | |
|---|---|
| ***E06B 1/14*** | (2006.01) |
| ***E06B 1/32*** | (2006.01) |
| ***E06B 1/36*** | (2006.01) |
| ***E06B 1/60*** | (2006.01) |

(52) U.S. Cl. ..... 52/204.5; 52/171.1; 52/203; 52/204.6; 52/204.62; 52/204.72; 52/208; 52/770; 52/781.3; 52/786.1

(58) Field of Classification Search ..... None
See application file for complete search history.

(56) References Cited

U.S. PATENT DOCUMENTS

| | | | |
|---|---|---|---|
| 2,374,057 | A | 5/1945 | Watkins |
| 2,398,886 | A | 4/1946 | Drake et al. |
| 2,567,353 | A | 9/1951 | Ryan |
| 2,659,686 | A | 11/1953 | Watkins |
| 4,241,556 | A | 12/1980 | Bursk |
| 4,796,400 | A | 1/1989 | Mulder |
| 4,920,718 | A | 5/1990 | Artwick et al. |
| 5,018,330 | A | 5/1991 | Lewkowitz |
| 5,154,953 | A | 10/1992 | de Moncuit et al. |

OTHER PUBLICATIONS

RSL Woodworking Products "Innovations" publications dated Winter 1989/1990 and Summer 1990 [pp. SDI 1–4].
Cadillac Plastic invoices dated Mar. 28, 1990 and Dec. 6, 1990 [pp. SDI 10–11].
"Altoona Mirror " news story entitled "Decorative glass lights firm's route success" dated Mar. 28, 1993 [pp. SDI 20–21].
DSI—Door Systems Incorporated sales handout (Undated) [pp. SDI 6–8].
RSL Woodworking Products, Co. sales brochure dated Jul. 1989 [p. SDI 9].
DSI–Door Systems Incorporated order to Signature Door dated Oct. 11, 1989 [p. SDI 5].
Novagard letter to Signature Door Co. Inc. dated Oct. 30, 1991; Certain Teed letter to Simonton Building Products (Undated); Vekaplast USA Inc. letter (Undated); and Sears letter dated Aug. 26, 1990 [pp. SDI 15–19].
Novagard, Inc. invoices dated Dec. 01, 1992, Apr. 22, 1992 and Jul. 31, 1992 [pp. SDI 12–14].
DSI—Door Systems Incorporated Catalog dated 1992 [pp. SDI 22–34].

(Continued)

*Primary Examiner*—Joseph A. Kaufman

(57) ABSTRACT

A penetration resistant door light adapted to withstand impact from flying debris as might occur in a hurricane or other high-wind condition. The door light includes inner and outer frame halves that support a panel assembly within an opening formed in a door. The panel assembly includes a sheet or layer of transparent impact resistant material such as a polycarbonate or laminated glass. The impact resistant sheet is structurally secured to at least screws extend through all of the inner frame half, the impact resistant sheet, and the outer frame half. In an alternative embodiment, a structural adhesive intersecures the impact resistant sheet and the outer frame half.

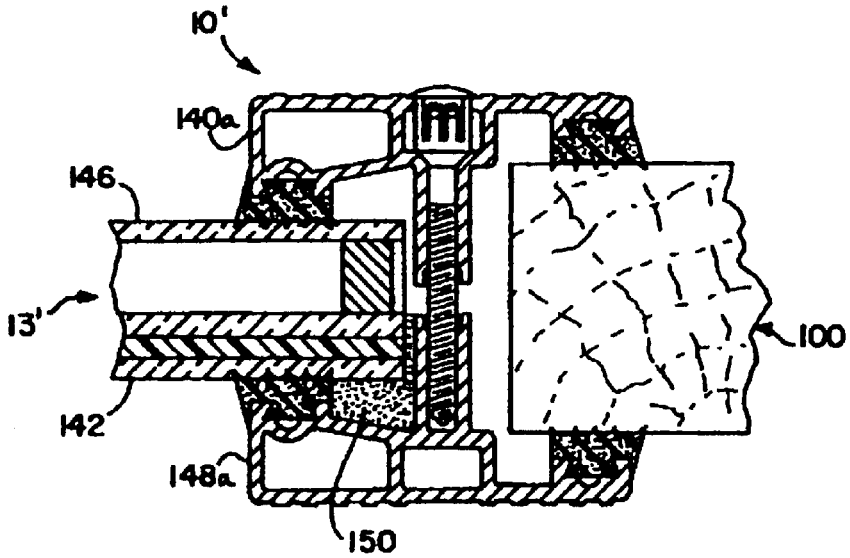

OTHER PUBLICATIONS

"Response of Structurally Glazed Insulating Glass Units to Wind Pressure," Bailey et al, Journal of Wind Engineering and Industrial Aerodynamics, 36 (1990), pp. 1163–1171 [pp. SDI 79–87].

"Stress Redistribution in Structural Glazing Joints," Sandberg et al, Science and Technology of Building Seals Sealants, Glazing, and Waterproofing, ASTM STP 1168 (1992), pp. 106–114 [pp. SDI 137–145].

"Sealant Stresses in Structural Glazing: A Mathematical Model," Vallbhan et al, Building Sealants: Material, Properties, and Performance, ASTM STP 1069, (1990), pp. 22–41 [pp. SDI 88–107].

"Silicone Sealant Helps Increase Productivity 10% in New Window Application," (Bears handwritten notation asserting publication in Plastics in Building Construction, V. 10 #8 dated 1987), pp. 4–5 [pp. SDI 108–109].

"New Technology in the Window Industry," Elmahdy et al, Building Science Insight '88 (http://irc.nrc–cnrc.gc.ca/bsi/88–5_E.html) (Printed Jul. 26, 2004) [pp. SDI 59–78].

Cross sectional sketch of admitted prior art.

"Silicone Structural Glazing Manual," Dow Corning (Jun. 1993), pp. 1–24 [pp. SDI 88–107].

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 2, 7, 9 and 10 is confirmed. Claims 3–6 and 8 were not reexamined.

* * * * *